US009776776B2

(12) United States Patent
Yamasaki

(10) Patent No.: US 9,776,776 B2
(45) Date of Patent: Oct. 3, 2017

(54) LIQUID DISPENSING DEVICE

(71) Applicant: Walter Yamasaki, Richmond, CA (US)

(72) Inventor: Walter Yamasaki, Richmond, CA (US)

( * ) Notice: Subject to any disclaimer, the term of this patent is extended or adjusted under 35 U.S.C. 154(b) by 0 days.

(21) Appl. No.: 14/751,270

(22) Filed: Jun. 26, 2015

(65) Prior Publication Data

US 2015/0375907 A1 Dec. 31, 2015

Related U.S. Application Data

(60) Provisional application No. 62/017,521, filed on Jun. 26, 2014.

(51) Int. Cl.

| | |
|---|---|
| ***B65D 47/06*** | (2006.01) |
| ***B65D 47/20*** | (2006.01) |
| ***B65D 39/16*** | (2006.01) |
| ***A47G 19/22*** | (2006.01) |
| ***B65D 41/04*** | (2006.01) |
| ***B65D 83/00*** | (2006.01) |

(52) U.S. Cl.

CPC ..... *B65D 47/06* (2013.01); *A47G 19/2266* (2013.01); *B65D 47/2031* (2013.01); *B65D 83/0038* (2013.01); *B65D 2547/066* (2013.01)

(58) Field of Classification Search

CPC ..... A47G 19/2266; B65D 2547/066; B65D 47/2031; B65D 83/0038; B65D 47/06

USPC ..... 222/340, 387, 392; 251/342

See application file for complete search history.

(56) References Cited

U.S. PATENT DOCUMENTS 1,717,672 A * 6/1929 Fitch ..... A47K 5/1211 222/340
2,314,261 A * 3/1943 Younghusband ..... A45D 40/10 222/340
2,666,555 A * 1/1954 Hill ..... A45D 40/26 222/340
2,758,758 A * 8/1956 Schimpf ..... F16N 3/12 222/327
3,231,147 A * 1/1966 Leahy ..... F16N 3/12 222/262
3,847,304 A * 11/1974 Cohen ..... B67D 7/0216 222/105
4,090,646 A * 5/1978 Dubiel ..... B65D 47/20 222/326
4,193,513 A * 3/1980 Bull, Jr. ..... G01F 11/02 222/1
4,223,808 A * 9/1980 Williams ..... B65D 83/0038 222/327

(Continued)

*Primary Examiner* — Nicholas J Weiss

(74) *Attorney, Agent, or Firm* — Global Intellectual Property Agency, LLC; Daniel Enea

(57) ABSTRACT

A liquid dispensing device for allowing a user to drink liquid therefrom in a hands-free manner. The liquid dispensing device includes a container having a spring-loaded stopper therein, and further including an elongated tube having a mouthpiece thereon that extends from an end of the container. In operation, a user can fill the container with a liquid causing the spring loaded stopper to retract so that it is under tension. When the user wishes to drink the liquid, the user can bite the bite valve of the mouthpiece which enables water to be released from the container and into a tube connected to the mouthpiece. The spring pushes the stopper towards the mouthpiece and thus the liquid within the container is pushed through the tube to the mouthpiece so the user may drink therefrom.

5 Claims, 2 Drawing Sheets

(56) References Cited

U.S. PATENT DOCUMENTS

| | | | | | |
|---|---|---|---|---|---|
| 4,792,066 | A * | 12/1988 | Kobayashi | E04G 23/0203 | 222/387 |
| 4,911,339 | A * | 3/1990 | Cushing | B62J 11/00 | 222/401 |
| 4,957,223 | A * | 9/1990 | Beilush | B05C 17/0136 | 222/326 |
| 4,991,742 | A * | 2/1991 | Chang | A61M 5/148 | 222/105 |
| 5,062,591 | A * | 11/1991 | Runkel | B62J 11/00 | 222/105 |
| 5,301,858 | A * | 4/1994 | Hollander | B62J 11/00 | 224/148.2 |
| 5,607,087 | A * | 3/1997 | Wery | B67D 1/0456 | 222/401 |
| 6,382,472 | B1 * | 5/2002 | Shoval | B67D 7/0227 | 222/256 |
| 6,513,686 | B1 * | 2/2003 | Ben-Sasson | B60N 2/4876 | 215/388 |
| 8,167,175 | B2 * | 5/2012 | Jaouen | A45D 27/10 | 222/145.5 |
| 8,714,464 | B2 * | 5/2014 | Carrozza | B62J 99/00 | 222/608 |
| 9,186,691 | B2 * | 11/2015 | Carrozza | B05B 11/3057 | |
| 2013/0008922 | A1 * | 1/2013 | Shen | B65D 83/0038 | 222/153.13 |

* cited by examiner

LIQUID DISPENSING DEVICE

CROSS REFERENCE TO RELATED APPLICATION

This application claims the benefit of U.S. Provisional Application No. 61/717,792 filed on Jun. 26, 2014 The above identified patent application is herein incorporated by reference in its entirety to provide continuity of disclosure.

BACKGROUND OF THE INVENTION

Field of the Invention

The present invention relates to liquid and beverage containers.

More specifically, the invention relates to a liquid dispensing container comprising a container with a spring loaded stopper therein, wherein a mouthpiece comprising a bite valve is in fluid communication with the container such that liquid is delivered to the mouthpiece when the user applies pressure to the bite valve.

A majority of water bottles require the user to squeeze the outside of the bottle in order to release water therefrom. This can be inconvenient and even dangerous if the user is riding a bike, driving, or performing another task that requires both hands and the user's full attention. Other water bottles require the user to invert the bottle and allow gravity to cause the water to dispense therefrom. These types of water bottles can also be annoying and inconvenient to use. Such water bottles may cause water to spill out of the spout and onto the user. Thus, there exists a need for a water bottle that can release water in a hands-free manner upon the user biting onto a mouthpiece for ease of use and convenience thereof.

SUMMARY OF THE INVENTION

In view of the foregoing disadvantages inherent in the known types of liquid dispensing devices now present in the prior art, the present invention provides a new liquid dispensing device wherein the same can be utilized for providing convenience for the user when riding a bicycle or performing another activity.

It is therefore an object of the present invention to provide a new and improved liquid dispensing device that has all of the advantages of the prior art and none of the disadvantages.

It is another object of the present invention to provide a liquid dispensing device comprising a container having a spring-loaded stopper therein and further having a mouthpiece in fluid communication with the container, wherein liquid is delivered from the container to the mouthpiece.

Another object of the present invention is to provide a liquid dispensing device that enables a user to drink water therefrom in a hands-free manner.

Yet another object of the present invention is to provide a liquid dispensing device having a mouthpiece that includes a bite valve therein.

Another object of the present invention is to provide a liquid dispensing device that may be readily fabricated from materials that permit relative economy and are commensurate with durability.

Other objects, features and advantages of the present invention will become apparent from the following detailed description taken in conjunction with the accompanying drawings.

BRIEF DESCRIPTIONS OF THE DRAWINGS

Although the characteristic features of this invention will be particularly pointed out in the claims, the invention itself and manner in which it may be made and used may be better understood after a review of the following description, taken in connection with the accompanying drawings wherein like numeral annotations are provided throughout.

DETAILED DESCRIPTION OF THE INVENTION

Figure 1:
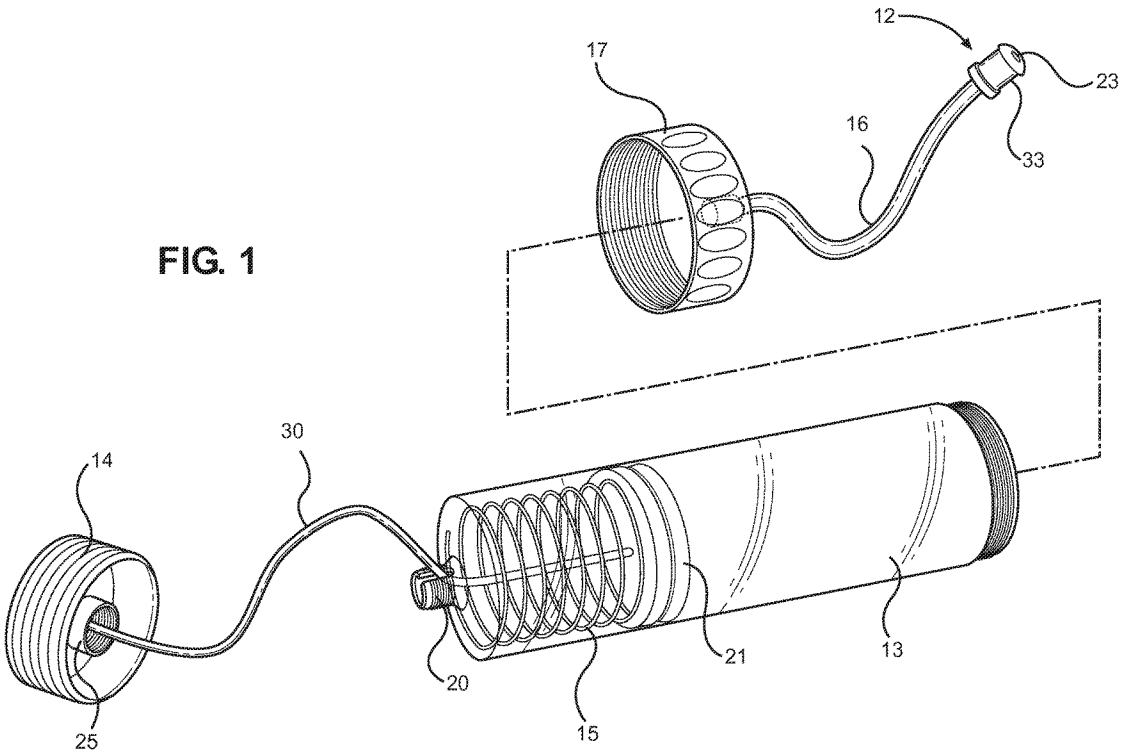
FIG. 1 shows a perspective view of the liquid dispensing device in a disassembled configuration.

Reference is made herein to the attached drawings. Like reference numerals are used throughout the drawings to depict like or similar elements of the liquid dispensing device. For the purposes of presenting a brief and clear description of the present invention, the preferred embodiment will be discussed as used for delivering a liquid to a user's mouth in a hands-free manner so that the user can drink a liquid while performing other activities. The figures are intended for representative purposes only and should not be considered to be limiting in any respect.

Referring now to FIG. 1, there is shown a perspective view of the liquid dispensing device in a disassembled configuration. The liquid dispensing device 11 comprises a container 13 having an interior volume such that it is adapted to store a liquid therein. The container 13 preferably has a cylindrical configuration with a first end, an open second end, and a unitary sidewall. The container 13 is preferably composed of a transparent material so that the user can see the interior volume of the container and the liquid held therein.

The first end 20 of the container 13 comprises a centrally located opening with a spout thereon adapted to removably engage with a first cap 14 used to seal the first end 20 of the container 13. The first cap 14 comprises a recess 25, wherein the recess 25 is preferably centrally located on the first cap 14 so as to removably engage with the spout on the first end 20 of the container 13. The recess 25 includes a threaded interior so as to engage with the threading on the exterior of the spout. The exterior of the first cap 14 further comprises a plurality of ridges in a preferred embodiment in order to enable the user to readily rotate the first cap 14 when applying or removing the first cap 14 to and from the first end 20 of the container 13.

A stopper 21 is disposed within the interior volume of the container 13 and the stopper 21 is connected to a spring 15 such that the stopper 21 is spring-loaded. A first end of the spring 15 is attached to the first end 20 of the container 13, and the second end of the spring 15 is attached to the stopper 21. The stopper 21 is circular in configuration and has the same diameter as that of the container 13 so that the stopper 21 provides a water-tight seal. The stopper 21 is held within the interior volume of the container, wherein the perimeter of the stopper 21 is flush against the interior of the container 13. The stopper 21 is movable between an extended or resting state, and a retracted state. When the container 13 is empty, the stopper 21 is in an extended state and the spring is not under tension. When the container 13 is filled with liquid, the stopper 21 is pushed towards the first end 20 of the container 13 such that the spring 15 is under tension.

A cable 30 connects the first cap 14 to the stopper 21 within the container 13. The user can pull the cable 30 outward and away from the container 13 so as to withdraw the stopper 21 into a retracted state wherein the spring 15 is under tension. Once the spring 15 is under tension, the user can secure the first cap 14 connected to the cable 30 to the first end 20 of the container 13. The spring 15 remains under tension until the user wishes to consume the liquid stored within the container 13. The cable 30 can be stored within the container 13 when the first cap 14 is secured thereon.

The second end of the container 13 is substantially open so that liquid can be poured into the interior volume of the container 13. A second cap 17 is removably securable to the second end of the container 13 so as to seal the same. The second cap 17 preferably comprises threading on the interior thereof adapted to removably engage with threading on the exterior of the second end of the container 13. The second cap 17 comprises a flexible, elongated tube 16 extending outwardly therefrom. A first end of the tube 16 is connected to the second cap 17, and a second end of the tube 16 includes a mouthpiece 12 thereon. In this way, the mouthpiece 12 is in fluid communication with the container 13 so that liquid within the container 13 can be supplied to the mouthpiece 12. The mouthpiece 12 preferably comprises a cylindrically shaped structure having a hollow interior volume and an opening 23 thereon so that fluid can escape from the mouthpiece 12.

The mouthpiece 12 comprises a bite valve 33 that enables liquid to be released from the mouthpiece 12 and into the users mouth. The bite valve 33 is adapted to remain closed until pressure is applied thereto, which causes the bite valve 33 to open, allowing liquid to flow therethrough. When in use, the user can place the mouthpiece 12 into one's mouth and proceed to bite down into the mouthpiece 12. With the bite valve 33 opened, the liquid held under pressure from the spring 15 and stopper 21 can flow from the interior volume of the container 13 through the interior volume of the tube 16, through the opening of the mouthpiece 12 and into the user's mouth. When the bite valve 33 is open, the spring 15 and stopper 21 within the interior volume of the container 13 move towards the second end of the container, pushing the water out of the container, and through the tube 16 to the mouthpiece 12.

Figure 2:
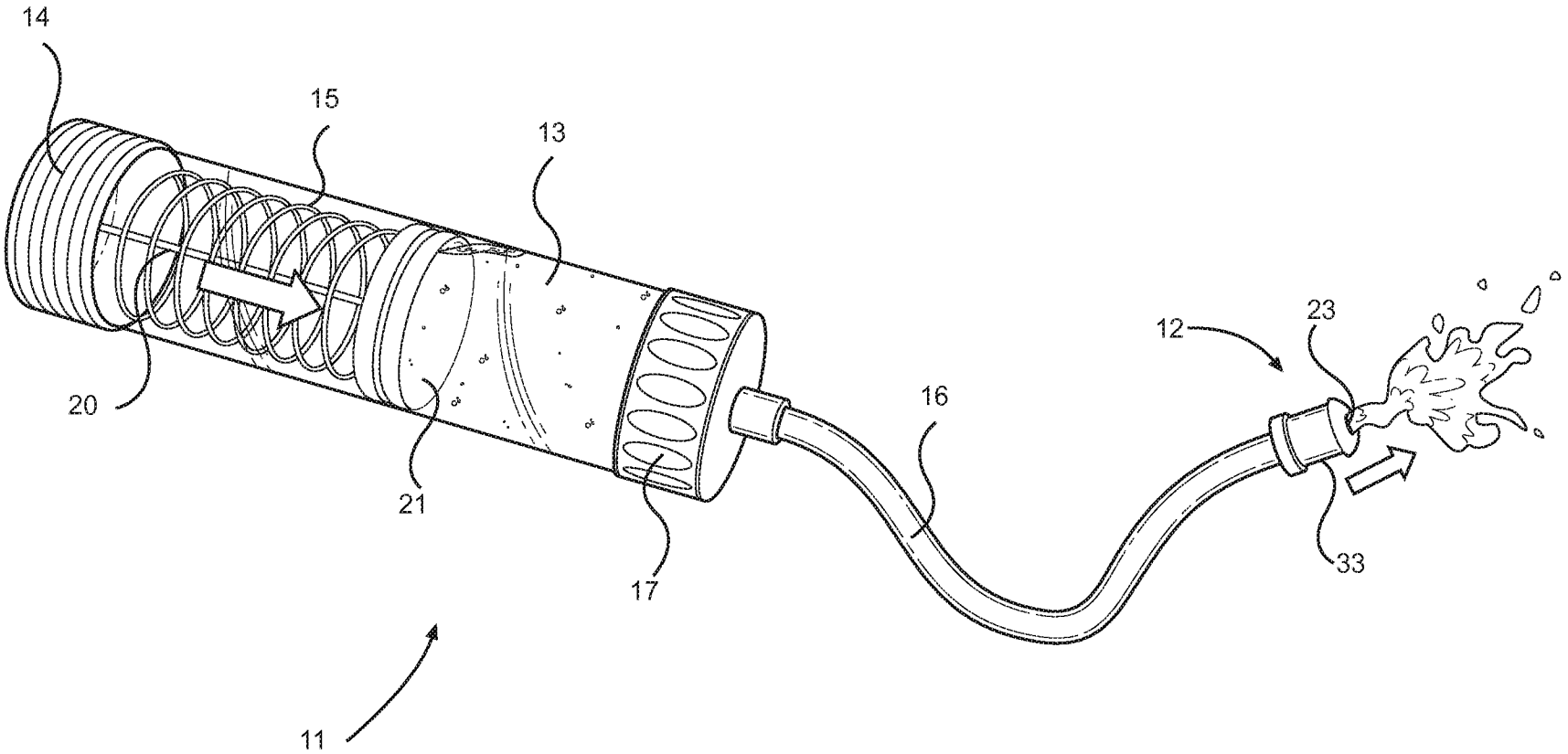
FIG. 2 shows a perspective view of the liquid dispensing device in use.

Referring now to FIG. 2, there is shown a perspective view of the liquid dispensing device in use. In operation, a user pulls the cable 30 attached to the stopper 21 so as to withdraw the stopper 21 towards the first end of the container 13 in a retracted state. The user can continue to pull and proceed to pull the cable 30 until the spring is fully retracted. With the spring fully retracted, the user can secure the cover 14 to the first end of the container 13.

The user can then fill the interior volume of the container 13 with a desired beverage. A second cap 17 is removably secured to the second end of the container 13. The second cap 17 preferably comprises threading that removably engages with threading on the exterior of the second end of the container 13, wherein the second cap 17 seals the second end of the container. The stopper 21 within the container 13 creates a watertight seal on the interior volume of the container 13 so that the liquid inserted into the container 13 will not contact the spring 15 or cable 30.

The user can then hold the mouthpiece 12 in his or her mouth, wherein the mouthpiece 12 is disposed on an elongated tube 16 connected to the second cap 17 on the second end of the container 13 such that the mouthpiece 12 is in fluid communication therewith. The mouthpiece 12 comprises a bite valve 33 that is sealed so as to maintain the pressure within the container 13. When the user bites on the bite valve 33, the bite valve 33 opens causing the liquid that is under pressure within the container 13 to be forced out of the container 13 via the movement of the spring 15 and stopper 21. The user can stop biting the bite valve 33 so as to close the valve, so that liquid stops escaping from the opening 23 of the mouthpiece 12.

It is therefore submitted that the instant invention has been shown and described in what is considered to be the most practical and preferred embodiments. It is recognized, however, that departures may be made within the scope of the invention and that obvious modifications will occur to a person skilled in the art. With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A liquid dispensing device, comprising:

a container having a first end, an open second end, and a unitary sidewall defining an interior volume in which a liquid can be stored;

a stopper movably positioned within said interior volume of said container;

a spring affixed at a first end to said stopper and affixed at a second end to said first end of said container;

a cable affixed at a first end to said stopper and affixed at a second end to a first cap, wherein said first cap is removably securable to said first end of said container;

a second cap removably securable to said second end of said container, wherein said second cap comprises an elongated tube thereon, wherein said elongated tube comprises a mouthpiece on an end thereof, such that said mouthpiece is in fluid communication with said container; and wherein said first cap is removably securable to said first end of said container via threaded engagement therewith.

2. The liquid dispensing device of claim 1, wherein said mouthpiece comprises a bite valve, such that when pressure is exerted on said mouthpiece, said bite valve allows said liquid held with said container to enter said mouthpiece.

3. The liquid dispensing device of claim 1, wherein said container is substantially cylindrical in configuration.

4. The liquid dispensing device of claim 1, wherein said second cap is removably securable to said second end of said container via threaded engagement therewith.

5. The liquid dispensing device of claim 1, wherein said elongated tube is flexible.

* * * * *